US010491994B2

(12) United States Patent
Slotte

(10) Patent No.: US 10,491,994 B2
(45) Date of Patent: Nov. 26, 2019

(54) METHODS AND APPARATUS FOR ADJUSTING FILTERING TO ADJUST AN ACOUSTIC FEEDBACK BASED ON ACOUSTIC INPUTS

(75) Inventor: Thomas Benedict Slotte, Turku (FI)

(73) Assignee: Nokia Technologies Oy, Espoo (FI)

( * ) Notice: Subject to any disclaimer, the term of this patent is extended or adjusted under 35 U.S.C. 154(b) by 348 days.

(21) Appl. No.: 13/583,775

(22) PCT Filed: Mar. 12, 2010

(86) PCT No.: PCT/IB2010/051081
§ 371 (c)(1),
(2), (4) Date: Nov. 19, 2012

(87) PCT Pub. No.: WO2011/110901
PCT Pub. Date: Sep. 15, 2011

(65) Prior Publication Data
US 2013/0188807 A1 Jul. 25, 2013

(51) Int. Cl.
*H04R 3/04* (2006.01)
*H04R 3/00* (2006.01)

(52) U.S. Cl.
CPC ..... *H04R 3/00* (2013.01); *H04R 3/04* (2013.01)

(58) Field of Classification Search
CPC ..... H04R 3/002; H04R 29/001; H04R 3/04; H04R 3/00; H04S 7/301; H04S 7/305; H04S 7/307
USPC ..... 381/96
See application file for complete search history.

(56) References Cited

U.S. PATENT DOCUMENTS 4,306,113 A 12/1981 Morton
4,458,362 A 7/1984 Berkovitz et al.
4,888,808 A 12/1989 Ishikawa et al.
6,282,296 B1 * 8/2001 Konno et al. ..... 381/96
(Continued)

FOREIGN PATENT DOCUMENTS

FR 2934738 A1 * 2/2010 ..... H04M 1/035
JP H0622389 A 1/1994
(Continued)

OTHER PUBLICATIONS

Extended European Search Report received for corresponding European Patent Application No. 10847315.8, dated Aug. 30, 2013, 6 pages.
(Continued)

*Primary Examiner* — Kile O Blair
(74) *Attorney, Agent, or Firm* — Harrington & Smith

(57) ABSTRACT

An apparatus comprising: at least one filter configured to filter an electrical input signal and provide a filtered electrical input signal to at least one speaker module configured to convert the filtered electrical input signal to an acoustic signal; and a detector configured to receive the filtered electrical input signal as a first input and an electrical output signal provided by at least one microphone as a second input; wherein the detector is configured to determine at least one difference between the electrical output signal provided by the at least one microphone and the filtered electrical input signal provided to said speaker module and, in response to the at least one difference provide a control signal to the filter to control the filter.

28 Claims, 6 Drawing Sheets

(56) References Cited

U.S. PATENT DOCUMENTS

| | | | | |
|---|---|---|---|---|
| 6,415,034 | B1 * | 7/2002 | Hietanen | G10K 11/1788 381/151 |
| 7,570,769 | B2 * | 8/2009 | Garcia et al. | 381/58 |
| 8,155,330 | B2 * | 4/2012 | Chen | 381/57 |
| 8,218,779 | B2 * | 7/2012 | Isberg | 381/58 |
| 9,344,051 | B2 * | 5/2016 | Rauhala | H03G 3/32 |
| 2001/0014161 | A1 * | 8/2001 | Baiker | H04M 1/6016 381/59 |
| 2002/0154761 | A1 | 10/2002 | McLaughlin et al. | |
| 2004/0184623 | A1 * | 9/2004 | Johannsen et al. | 381/117 |
| 2007/0223736 | A1 | 9/2007 | Stenmark et al. | |
| 2010/0329473 | A1 | 12/2010 | Rauhala | |
| 2011/0130175 | A1 * | 6/2011 | Bourgoin | H04M 1/035 455/569.1 |

FOREIGN PATENT DOCUMENTS

| | | | |
|---|---|---|---|
| WO | 1994/023419 | A1 | 10/1994 |
| WO | 9429848 | A1 | 12/1994 |
| WO | 1996/032776 | A2 | 10/1996 |
| WO | 2001/039370 | A2 | 5/2001 |

OTHER PUBLICATIONS

Office action received for corresponding Chinese Patent Application No. 201080065376.0, dated Jun. 27, 2014, 6 pages of Office Action and No English Translation available.

International Search Report and Written Opinion received for corresponding International Patent Application No. PCT/IB2010/051081, dated Nov. 17, 2010, 13 pages.

* cited by examiner

METHODS AND APPARATUS FOR ADJUSTING FILTERING TO ADJUST AN ACOUSTIC FEEDBACK BASED ON ACOUSTIC INPUTS

RELATED APPLICATION

This application was originally filed as PCT Application No. PCT/IB2010/051081 filed Mar. 12, 2010.

The present invention relates to an apparatus, method and computer program. The invention further relates to, but is not limited to, an apparatus for use in portable devices for controlling an acoustic signal provided by a sound generating system.

Telecommunication devices such as mobile or cellular handsets or other portable devices such as gaming devices or music players are known to include one or more speaker modules with a suitable sound generating system comprising suitable software algorithms, electrical circuitries and mechanical arrangements. The speaker module can for example reproduce a downlink or received audio signal or reproduce any compatible format audio signal. In recent years, speaker systems have been designed to assist different use cases such as music playback, ringtone playback, FM radio playback etc. The performance and quality of these speaker modules are related to various components such as the speaker module mechanical arrangement, signal processing algorithms and/or applications, and the electrical circuitry. The speaker modules are typically integrated within the housing of the devices and the integration techniques vary from design to design. In addition, other modules such as the signal processing algorithms may be designed relative to hardware integration of the speaker modules.

Apparatus such as mobile telephones may comprise at least one speaker module for example a loudspeaker, an earpiece, a multi-function-device or a suitably designed sound reproduction module in order to generate an acoustic signal to the exterior. The acoustic signal may be required to meet certain criteria including performance and quality of the playback system. The acoustic signal of the device may be controlled to provide a particular standard of sound quality to a user and therefore some dedicated software algorithms may be used to adjust the acoustic signal.

Although the sound modules are typically adjusted dependent on the application the device is being used as the position of the device may be different depending on how user operates the device in such applications. For example a user may position the device on a table during a "handsfree" speech call, or hold the device in hand. Accordingly, the device position within which the device is located may alter the characteristics of the acoustic signal and have a detrimental effect to the quality of the acoustic signal.

It is useful to therefore ensure that such devices give a consistent level of performance irrespective of how the device is positioned or operated during use.

There is provided according to a first aspect of the invention apparatus comprising: at least one filter configured to filter an electrical input signal and provide a filtered electrical input signal to at least one speaker module configured to convert the filtered electrical input signal to an acoustic signal; a detector configured to receive the filtered electrical input signal as a first input and an electrical output signal provided by at least one microphone as a second input; wherein the detector is configured to determine at least one difference between the electrical output signal provided by the at least one microphone and the filtered electrical input signal provided to said speaker module and, in response to the at least one difference provide a control signal to the filter to control the filter.

In some embodiments of the invention the detector of the apparatus may be configured to determine the at least one difference between a frequency response of the filtered electrical input signal and a frequency response of the electrical output signal provided by the at least one microphone. The determined difference may be between a signal level of the filtered electrical input signal and a signal level of the electrical output signal provided by the at least one microphone or alternatively the difference may be between a signal amplitude for at least one frequency region of the filtered electrical input signal and a signal amplitude for the same at least one frequency region of the electrical output signal provided by the at least one microphone.

The determined difference may be a difference between the filtered electrical input signal and the electrical output signal in the time domain provided by a cross-correlation process.

In some embodiments of the invention the apparatus may further comprise at least one sensor configured to determine a change in the position of the apparatus, wherein the sensor may be configured to provide a position indicator signal to the detector.

In some embodiments of the invention as described in preceding paragraphs the filter may comprise a plurality of pre-determined filters, and wherein the filter may select at least one of the pre-determined filters dependent on the detector control signal.

In some embodiments of the invention as described in preceding paragraphs the microphone may be configured to detect an acoustic signal comprising at least one component generated by the speaker module. The microphone of the apparatus may be positioned in proximity to the speaker module.

In some embodiments of the invention as described in preceding paragraphs the filtered electrical input signal provided to the speaker module and the output electrical signal provided by the microphone may comprise a first frequency band and a second frequency band, and the detector may be further configured prior to determining at least one difference between the electrical output signal provided by the at least one microphone and the filtered electrical input signal provided to said speaker module to determine a preliminary difference between the first frequency band filtered electrical signal input signal provided to the speaker module and the first frequency band output signal provided by the microphone, to modify at least one of the filtered electrical input signal provided to the speaker module and the output electrical signal provided by the microphone may be dependent on the preliminary difference.

In some embodiments of the invention the detector may be configured to determine the position of the apparatus relative to a supporting surface.

In some embodiments of the invention the determined difference may provide a measure comprising at least one of: the frequency response of an audio environment surrounding the apparatus; and the time domain response of an audio environment surrounding the apparatus.

In some embodiments of the invention the apparatus may be a wireless communications apparatus.

In a further aspect of the invention there is a method comprising: receiving at least one filtered electrical input signal wherein the filtered electrical input signal is also provided to at least one speaker module; receiving an electrical output signal provided by at least one microphone;

determining at least one difference between the electrical output signal provided by the at least one microphone and the filtered electrical input signal provided to said speaker module; and providing, in response to the at least one difference, a control signal to at least one filter to control the filter to filter the electrical input signal provided to the speaker module.

In some embodiments of the invention the method as described above may comprise the least one difference of: a difference between a frequency response of the filtered electrical input signal and a frequency response of the electrical output signal provided by the at least one microphone; a difference between a signal level of the filtered electrical input signal and a signal level of the electrical output signal provided by the at least one microphone; a difference between a signal amplitude for at least one frequency region of the filtered electrical input signal and a signal amplitude for the same at least one frequency region of the electrical output signal provided by the at least one microphone; and a difference may be a difference between the filtered electrical input signal and the electrical output signal in the time domain provided by a cross-correlation process.

In some embodiments of the invention the method as described above may further receive a position indicator signal; and wherein in response to the position indicator signal modifying the control signal.

In some embodiments of the method as described above may be provided a received position indicator signal; and wherein in response to the position indicator signal modifying the control signal. The method as described above may further select at least one filter from a plurality of predetermined filters dependent on the control signal.

In some embodiments of the invention there may be provided a microphone in proximity to the speaker module.

In some embodiments of the invention there may be provided a filtered electrical input signal provided to the speaker module and the output electrical signal provided by the microphone comprise a first frequency band and a second frequency band, and the method, prior to determining at least one difference between the electrical output signal provided by the at least one microphone and the filtered electrical input signal provided to said speaker module, comprising: determining a preliminary difference between the first frequency band filtered electrical signal input signal provided to the speaker module and the first frequency band output signal provided by the microphone; modifying at least one of the filtered electrical input signal provided to the speaker module and the output electrical signal provided by the microphone dependent on the preliminary difference.

In some embodiments of the invention the method as described above may further determine the position of the apparatus relative to a supporting surface.

In some embodiments of the invention the method as described above may determine the difference and provide a measure comprising at least one of: the frequency response of an audio environment surrounding the apparatus; and the time domain response of an audio environment surrounding the apparatus.

According to a further aspect of the invention there is provided a computer program comprising computer program instructions configured to control an apparatus, the program instructions enabling, when loaded into a controller: receiving at least one filtered electrical input signal wherein the filtered electrical input signal is also provided to at least one speaker module; receiving an electrical output signal provided by at least one microphone; determining at least one difference between the electrical output signal provided by the at least one microphone and the filtered electrical input signal provided to said speaker module; and providing, in response to the at least one difference, a control signal to at least one filter to control the filter to filter the electrical input signal provided to the speaker module.

In some embodiments of the invention there may be provided a computer program comprising program instructions for causing a computer to perform the method described above.

In some embodiments of the invention there may be provided a computer-readable storage medium encoded with instructions that, when executed by a processor, perform the method described above.

For better understanding of the present invention, reference will now be made by way of example to the accompanying drawings in which.

Figure 3:
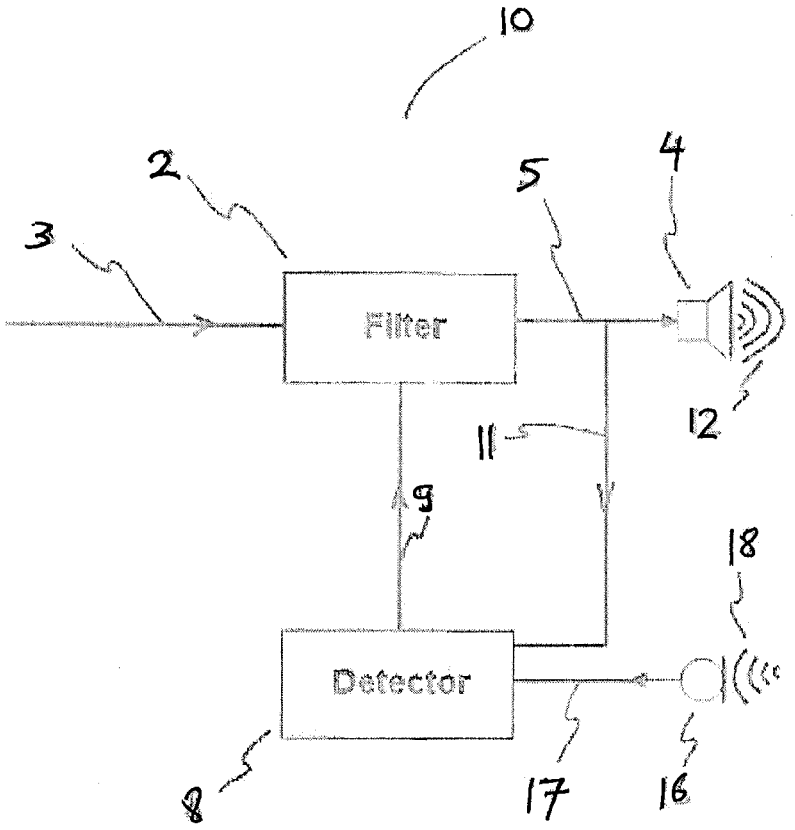
Figure 4:
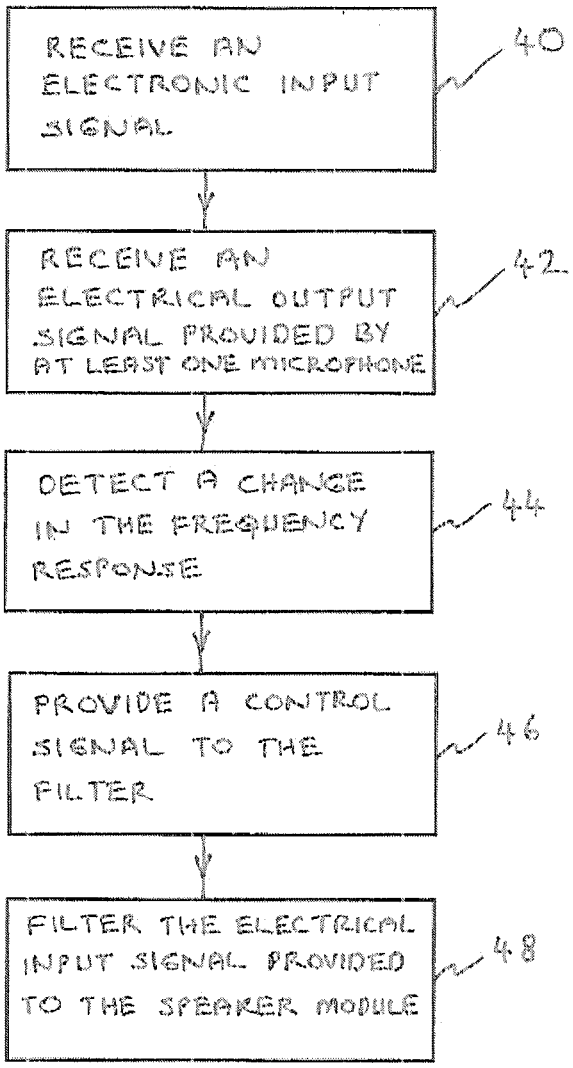
Figure 5A:
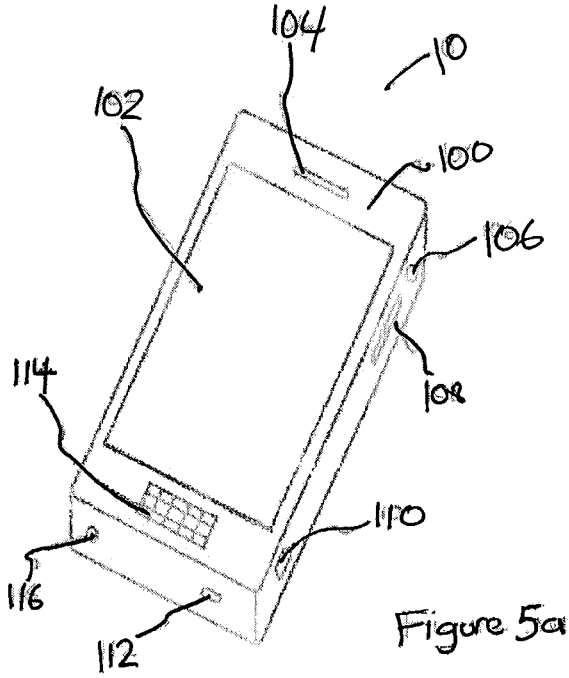
Figure 5B:
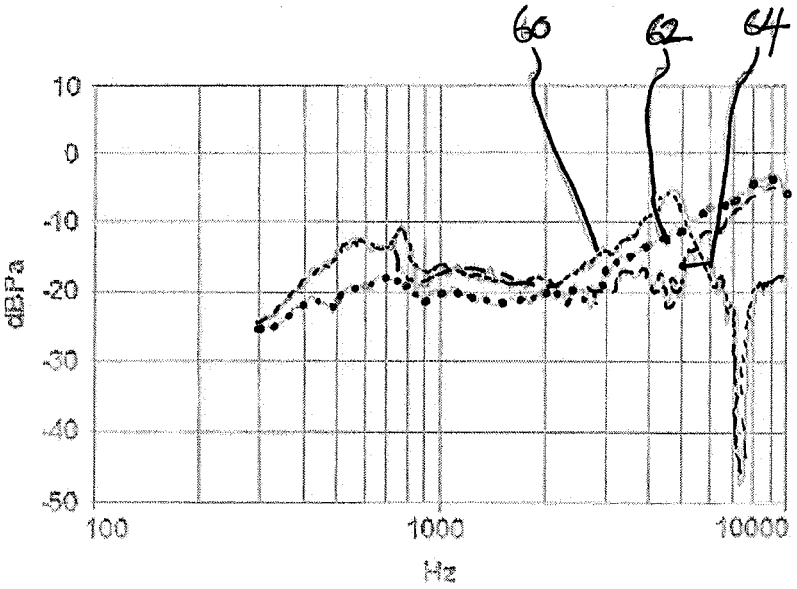
Figure 6:
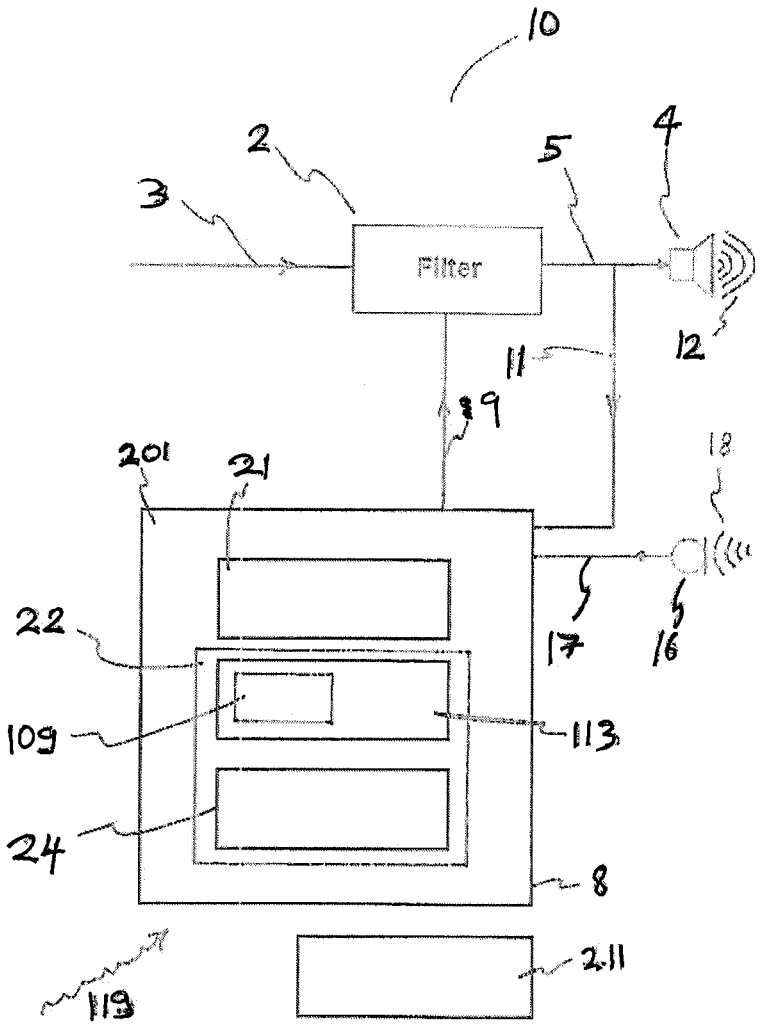

FIG. 3 schematically illustrates an apparatus according to some embodiments;

FIG. 4 illustrates a flow chart showing a method according to some embodiments;

FIG. 5*a* shows schematically an apparatus employing some alternative embodiments;

FIG. 5*b* shows a frequency response curve plot being based on embodiments presented in FIG. 5*a* according to the application; and FIG. 6 illustrates an apparatus according to some further embodiments of the application.

Figure 1:
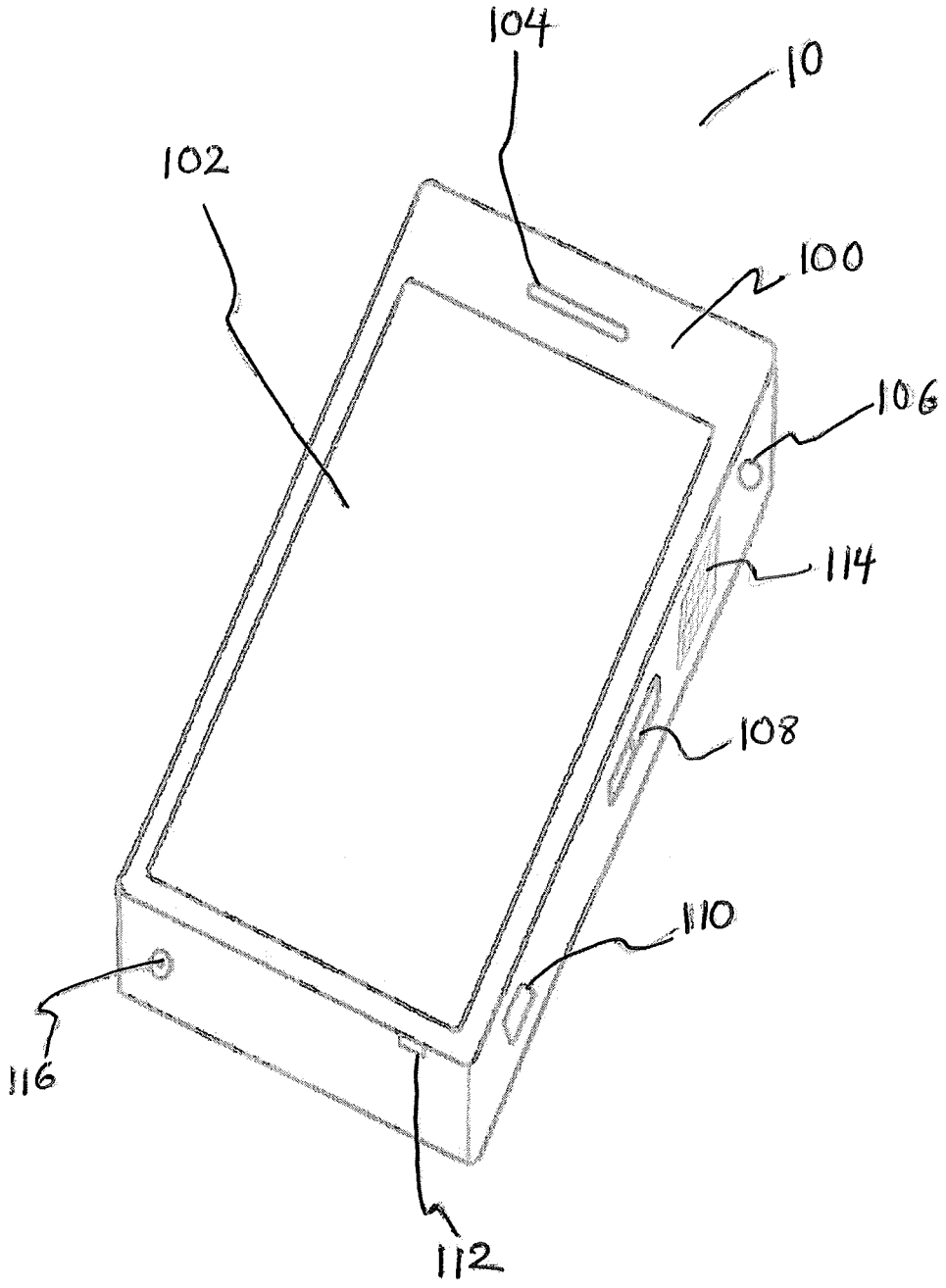
FIG. 1 shows schematically an apparatus employing some embodiments.

The following describes in further detail suitable apparatus and possible mechanisms for the provision of acoustic signal such as those provided for handsfree operations configuring a speaker module. In this regard reference is first made to FIG. 1 which shows an illustration of an example apparatus comprising a speaker module and at least one physical aperture designed for the apparatus. The apparatus as shown in FIG. 1 is an user equipment in the form of a mobile phone. However it would be appreciated that some embodiments of the application may comprise apparatus implementing a transducer which may be a speaker module, for example but not exclusively an audio player (such as a mp3 player) or media player (such as a mp4 player), a portable computer (for example a laptop/netbook with speakers), a portable DVD/Blu-ray player.

FIG. 1 shows a 3 dimensional view of an apparatus operating as a mobile phone 10 according to some embodiments.

The mobile phone 10 in some embodiments comprises an outer cover 100 which houses any internal components. The outer cover 100 in some embodiments comprises a display region 102 through which a display panel is visible to a user. The outer cover 100 in some embodiments further comprises at least one earpiece sound aperture 104. In these embodiments the earpiece sound aperture 104 can include a separate bezel for the sound aperture 104 or in some other embodiments can be formed as part of the outer cover 100 or the display region 102. When the sound aperture 104 is placed adjacent to a user's ear, sound generated by an earpiece module (not shown) is audible to the user. The mobile phone 10 in some embodiments further comprises a volume control button 108 with which the user can control the volume of an output of a speaker module (not shown). The mobile phone 10 in some embodiments further comprises at least one speaker sound outlet 114 which may be used to radiate sound waves generated by a speaker module (not shown). The speaker module may be used for handsfree operations such as music playback, ringtone alerts, handsfree speech and/or video call audio reproduction. The loudspeaker sound outlet 114 in such embodiments couples the acoustic output of the speaker module to the exterior of the mobile phone 10. In some embodiments, the loudspeaker sound outlet 114 can comprise a suitable mesh structure or grill which may take various forms, shapes or materials and which may be designed in relation to the speaker module to produce a desired frequency response when operated in 'free air'. The loudspeaker sound outlet 114 furthermore in some embodiments can be structured as an array of individual small openings or may be a single cross sectional area. The loudspeaker sound outlet 114 in some embodiments can be rectangular, cylindrical or any suitable shape. In some embodiments the casing may comprise at least one microphone inlet 112 suitable for a microphone module (not shown) to capture acoustic waves and output representations of the acoustic waves as electrical signals which then may be processed and transmitted to other devices or stored for later playback.

The mobile phone 10 in some embodiments further can provide at least one interface enabling the user to interface external devices or equipment to the mobile phone 10. For example in some embodiments an audio connector socket 106 may be suitably positioned in the mobile phone 10. In some embodiments, the audio connector socket 106 may be substantially hidden behind a suitably arranged door or lid. The audio connector socket 106 may be suitable for connection with an audio connector (not shown) or may be suitable for connection with an audio or audio/visual (A/V) connector plug. The audio connector socket 106 in such embodiments therefore provides a releasable connection with audio or A/V plugs (not shown). The mobile phone 10 in some embodiments can comprise a universal serial bus (USB) interface socket 110. The USB interface socket 110 is in these embodiments suitably arranged to receive a USB connector plug (not shown). The mobile phone 10 in some embodiments can further require a charging operation and therefore in these embodiments comprises a charging connector socket 116. The charging connector socket 116 can in these embodiments be of various sizes, shapes and combinations or in some embodiments can be visually or substantially hidden. Furthermore although in the above the connectors are described as being sockets suitable for receiving compatible plugs it would be appreciated that the mobile phone can feature in some embodiments plugs suitable for any of the above connection functionality. From here on the connections are therefore described by the generic term 'connector'.

It should be understood that the position of modules and apertures described in the example embodiments are examples only and alternative embodiments can have different arrangements and configurations of the above connections, outlets and inlets.

Figure 2:
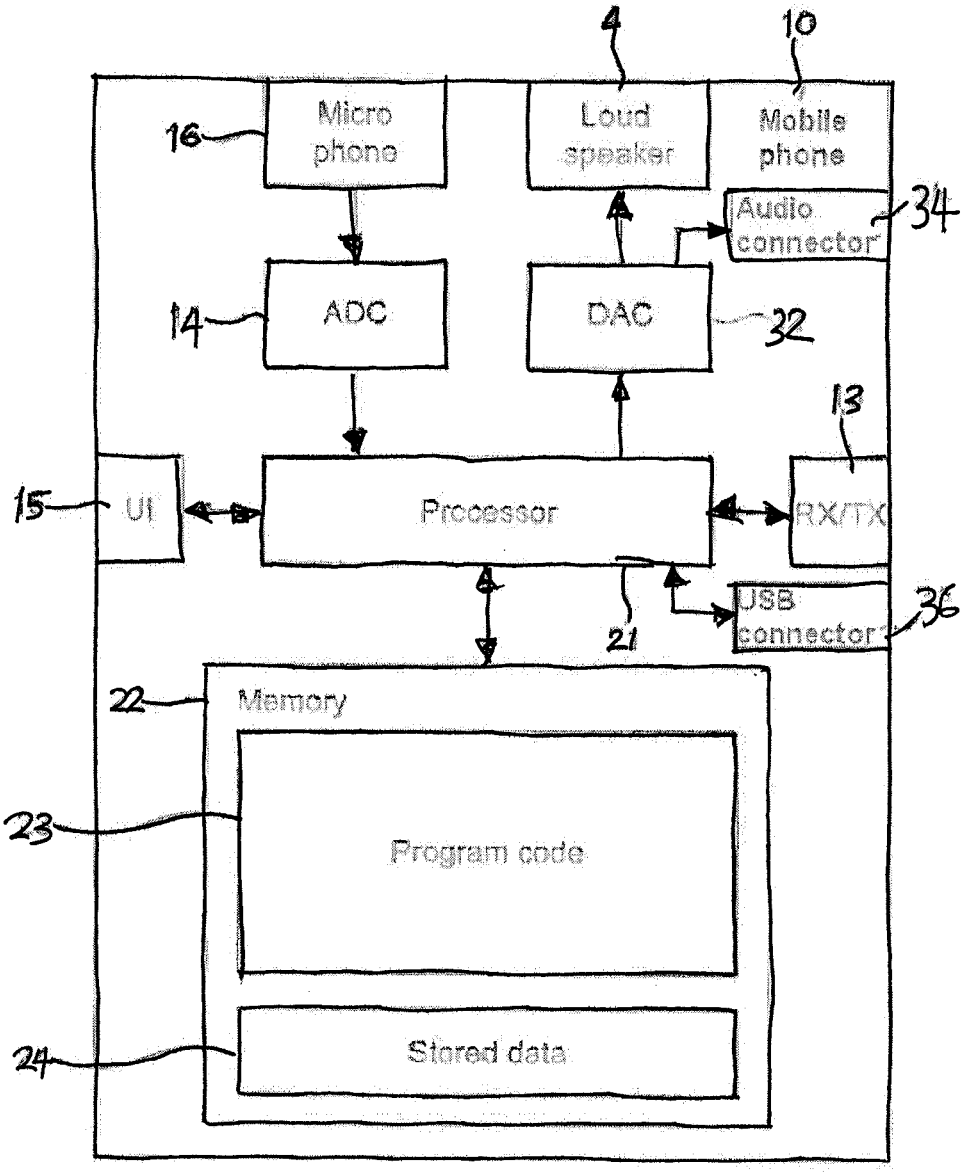
FIG. 2 shows schematically the apparatus shown in FIG. 1 in further detail.

In FIG. 2, a schematic block diagram of an exemplary mobile phone 10 or apparatus is explained in further detail.

The mobile phone 10 comprises a processor 21 which may be linked via a digital-to-analogue converter (DAC) 32 to a speaker module wherein the speaker module is a loudspeaker 4. The loudspeaker in some embodiments may be connected to an external electronic device via an audio connector 34, which can in some embodiments be the audio connector socket 106. In some embodiments the loudspeaker 4 may be used as an earpiece module suitable for handset speech call. The mobile phone 10 in some embodiments further comprises at least one microphone 16 (which in some embodiments is acoustically connected via the microphone inlet 112) and an analogue-to-digital converter (ADC) 14 configured to convert the input analogue audio signals from the at least one microphone 16 into digital audio signals and provide the digital audio signals to the processor 21.

In some embodiments, the mobile phone 10 can comprise an array of microphones. In some embodiments at least one of the microphones 16 can be implemented by an omnidirectional microphone. In other words the microphones in these embodiments can respond equally to acoustic signals from all directions. In some other embodiments at least one microphone comprises a directional microphone configured to respond to acoustic signals in predefined directions. In some embodiments at least one microphone comprises a digital microphone, in other words a regular microphone with an integrated amplifier and sigma delta type A/D converter in one component block. The digital microphone in some embodiments may further comprise an input which is also utilized for other ADC channels such as transducer processing feedback signal or for other enhancements such as beamforming or noise suppression.

The mobile phone 10 can comprise in some embodiments multiple transducer modules that serve the different use cases. The audio connector 34 in some embodiments provides a physical interface to an external module such as a headphone or headset or any suitable audio transducer equipment suitable to receive output signals from the DAC 32. In some embodiments both the loudspeaker 4 and the audio connector 34 are provided in the mobile phone 10. Furthermore in some embodiments the external modules may connect to the mobile phone 10 wirelessly via a transmitter or transceiver, for example by using a low power radio frequency connection such as Bluetooth A2DP profile. The processor 21 in some embodiments is further linked to a transceiver (TX/RX) 13 suitable for transmitting data and receiving data from external devices or apparatus, to a user interface (UI) 15 suitable for displaying data to the user and/or receiving data from the data. For example the UI 15 may be provided by the display and by the volume control button 108. Furthermore the processor in some embodiments can be connected to a memory 22 for storing data and instructions to be performed by the processor 21.

It is shown the mobile phone 10 comprises a USB connector 36, for example the USB connector socket 110. The USB connector 36 in some embodiments is a standard USB, a micro USB, or a mini USB sized connection. The USB standard provides specifications for a host, a device and the cabling which links them. Amongst other requirements of the standard, a USB host may be capable of detecting the speed of those devices with which it is communicating. In some embodiments, the USB connector provides releasable connection with audio or A/V USB plugs (not shown). The mobile phone 10 can in such embodiments comprise a suitably integrated USB control function which may be controlled by the processor.

The processor 21 can be configured to execute various program codes. The implemented program codes in some embodiments comprise configuring settings for generating suitable audio signals to the loudspeaker 4 and/or the audio connector 34. The implemented program codes 23 in some embodiments can be stored for example in the memory 22 for retrieval by the processor 21 whenever needed. In some embodiments, the settings are adaptively generated or configured to be suitable for dedicated use cases. The memory 22 in some embodiments further provides a section 24 for storing data, for example data that has been processed in accordance with the embodiments.

The user interface 15 enables a user to input commands to the mobile phone 10, for example via a keypad and/or a touch interface. Furthermore the mobile phone or apparatus 10 can in some embodiments comprise a display. The processor in some embodiments can generate image data to inform the user of the mode of operation and/or display a series of options from which the user can select using the user interface 15. For example the user may select or scale a gain effect or an equalizer setting for audio signals to set a custom playback characteristic which may be modified depending on which speaker module or external module is used. In some embodiments the user interface 15 in the form of a touch interface can be implemented as part of the display in the form of a touch screen user interface.

The transceiver 13 in some embodiments enables communication with other electronic devices, for example via cellular or mobile phone gateway servers such as Node B or base transceiver stations (BTS) and a wireless communication network, or short range wireless communications to the microphone or external modules where they are located remotely from the apparatus.

It is to be understood again that the structure of mobile phone 10 could be supplemented and varied in many ways.

FIG. 3 schematically illustrates an apparatus or mobile phone 10 according to some embodiments. The apparatus in such embodiments comprises a filter 2, a speaker module 4, a microphone 6 and a detector 8. It should be understood that the apparatus 1 may comprise additional features that are not illustrated in this example embodiment.

The speaker module 4 may be a loudspeaker or other form of transducer that reproduces sound waves.

The filter 2 is configured to receive an electrical input signal 3 and provide a filtered electrical output signal 5 to the speaker module 4. The electrical input signal 3 may be received from an audio apparatus. The audio apparatus may be any means which produces an audio output such as the processor of the mobile phone. The electrical input signal 3 in some embodiments can be a speech signal which is part of a telephone conversation, a music audio signal for playing a music file from a memory 22, a ringtone file to alert the user, or any other suitable signal to be reproduced by the speaker module 4.

The electrical input signal 3 provided to the filter 2 can comprise in some embodiments at least one frequency component or alternatively a plurality of different frequency components. The electrical input signal 3 furthermore can comprise other signal means such noise, click, pulse signals. The filter 2 in some embodiments can be configured to filter the electrical input signal 3 by suitably shaping at least one frequency component of the electrical input signal 3. In some embodiments the full frequency spectrum of the electrical input signal 3 is therefore suitably processed by the filter 2 in that frequency components of the full frequency spectrum are processed.

In some embodiments of the invention the filter 2 can be configured to attenuate some frequency components and enhance other frequency components of the electrical input signal 3. In some embodiments the filter 2 can be an equalization filter. For example in these embodiments the filter 2 can receive a control signal 9 provided by the detector 8 wherein the detector 8 is configured to produce a control signal dependent on the difference between a electronic input signal 11 from the output of the filter 2 and a electrical output signal 17 received from at least one microphone 16. In such a manner the filter 2 can suitably filter the input signal and be configured to operate as any known filter configuration, for example as a band-pass filter, a low-pass filter, a high-pass filter, or any general equalization filter.

In some alternative embodiments of the invention, the filter 2 may receive the control signal 9 provided by the detector 8 wherein more than one filter is suitably designed to provide the control signal 9 such as a filter-bank that may be designed in the form of plural band-pass filters wherein the bandwidth and centre frequencies of each filter of the filter-bank may be suitably designed. The filter-bank in such embodiments can be a specially designed auditory filter-bank based on psychoacoustics modelling relative to human hearing mechanism. In some further embodiments, the control signal 9 can be provided following a filtering process whereby a specially designed combination of different filters may be used to provide the control signal before being used to configure the filter 2 operating on the electronic input signal 3. It is understood that in such embodiments both the filter 2 and the filtering process for the control signal 9 can be any filter. For example a single, plural, or alternatively combinations to suitably filter the electrical input signal 3.

The filter 2 in some embodiments can be configured to filter the electrical input signal 3 to enable the audible or acoustic signal 12 provided by the speaker module 4 in response to the filtered electrical output signal 5 to fulfil certain criteria. For example the filter 2 may be a filter with a flat pass-band in some use cases (these use cases can be for example ringtone playback use) so that at least one acoustic resonance or more may be generated so that user can hear a loud enough audible signal. The speaker module 4 when integrated in the mobile phone 10 can comprise at least one arrangement such as at least one acoustic cavity with suitably designed apertures and/or sound outlets such as the sound outlet 114 as in FIG. 1. The filter 2 in such embodiments can enhance or attenuate certain frequencies to provide an improved sound quality for the user of the apparatus 10 such as music signal playback or speech call. The filter 2 furthermore in some embodiments can assist the production a desired frequency response to the ear and thus improve the perceived audio quality.

In some embodiments, the filter 2 can produce a desired frequency response which may be unique and different for related use cases. For example, the filter 2 can in some embodiments produce a desired frequency response that may have at least one of a different bandwidth, level, or shape depending on the use case.

The speaker module 4 is configured to convert the filtered electrical input signal 3 to an acoustic signal 12. The acoustic signal 12 may comprise at least one frequency component. Or a plurality of different frequency components from the audible frequency range. The acoustic signal 12 for example can comprise a first frequency component, a second frequency component, and a third frequency component. The first frequency component in such embodiments can be a low frequency component, for example, the first frequency component may comprise frequencies in the range 0-1 kHz. The second frequency component in these embodiments can be a mid frequency component, for example in the range 1-3 kHz. The third frequency component furthermore in these embodiments can be a high frequency component in the range 3-10 kHz.

In embodiments of the invention where the apparatus 10 is a mobile telephone the acoustic signal 12 can represent a speech signal which is part of a telephone conversation.

The microphone 16 is configured in some embodiments to detect the acoustic input signal 18 and convert this into an electrical output signal 17. The microphone 16 in some embodiments can be positioned within the mobile phone 10 so that the acoustic input signal 18 is detected and provides a measure of the frequency response of the system comprising the apparatus 10 and other surrounding objects comprising the user. The acoustic input signal 16 can in some embodiments comprise components of the acoustic signal 12. The frequency response of the acoustic input signal 18 can in these embodiments be dependent on the position of the mobile phone 10, and/or how the mobile phone 10 is positioned by the user. For example the frequency response can depend on how the mobile phone 10 is operated by the user and the distance between the speaker module 4 and the microphone 16. For example the frequency response of the acoustic input signal 18 can depend on whether the mobile phone 10 is positioned on a flat surface such as a table, the physical distance between the speaker module 4 and the microphone 16. In such embodiments the physical arrangement or configuration including the distance between the outlets and inlets can be important in defining the frequency response of the acoustic input signal 18. So that in some embodiments the distance and arrangement between the sound outlet 114 and the microphone inlet 112 as presented in FIG. 1 can significantly affect the frequency response of the acoustic input signal 18.

The detector 8 in these embodiments can be configured to receive the filtered electronic input signal 11 from the output of the filter 2 as a first input and the electrical output signal 17 provided by the microphone 16 as a second input. The detector 8 is thus in these embodiments configured to compare the frequency response of the electrical output signal 17 provided by the microphone 16 to the frequency response of the filtered electronic input signal 11 and detect a change in the relative frequency components.

In some alternative embodiments, the electronic input signal 11 from the output of the filter 2 can be considered as a target signal and the detector can detect or determine the relative change between the target signal and the detected acoustic signal 18 by monitoring and analysing the electrical output signal 17 from the microphone 16. The range of frequency response detected or monitored in some embodiment can be a pre-determined bandwidth and therefore the comparison can be performed over the range of the predetermined bandwidth. For example, as some frequency or frequency components can be more sensitive to positional changes of the apparatus 10 and thus these frequency ranges are the ranges monitored by the detector 8. For example when the apparatus is positioned on a flat surface low frequency components are often affected due to the coupling between the apparatus and the flat surface the apparatus is placed on.

In some embodiments, the detector is configured to monitor the signal level of the electrical output signal 17 from the microphone 16 to the signal level of the filtered electronic input signal 11 and the detector 8 configured to output a control signal dependent on the relative signal level. The signal level in such embodiments can be determined over an appropriate time interval. For example, the signal level may be calculated over the duration of each signal frame such as a typical speech frame of 20 ms. In some further embodiments, the signal level can be determined in the frequency domain.

The detector 8 in some embodiments is configured to provide the control signal 9 in response to the detection of a change in the frequency response. In other words the detector 8 is configured to generate in these embodiments a control signal 9 when the frequency response of the electrical output signal 17 from the microphone differs from the frequency response of the filtered electronic input signal 11 by a predetermined amount. It is to be understood that the configuration may comprise other variations and modifications to provide the control signal 9. For example but not exclusively the control signal 9 may be provided continuously. This predetermined amount in some embodiments can be defined by a frequency distribution. In other words in some embodiments the predetermined amount or trigger can be a frequency dependent value whereby differences at known acoustically important frequencies can differ by a smaller amount than acoustically less important frequencies before triggering a control signal 9. In some embodiments the threshold can be determined as a cumulative frequency error distribution whereby differences at various frequencies are weighted and combined and a control signal 9 generated by the detector when a total combined distribution error value is greater than an error threshold value.

In some embodiments, the detector 8 can detect a change related to a signal level difference between the signal level of the electrical output signal 17 from the microphone and the signal level of the filtered electronic input signal 11.

A change in the relative frequency response can occur if, for example, a user changes the position of the apparatus 10. The position of the apparatus on a table can thus influence the playback characteristics of the speaker module 4 and therefore the audible or acoustic output signal 12. This change, in embodiments, can also influence the electrical output signal 17 provided by the microphone 16.

In some embodiments, the detector 8 is configured to provide the control signal 9 in response to the detection of a change in the amplitude of at least one frequency component of the electrical output signal 17 from the microphone. A change in the amplitude of at least one frequency component can occur as described above, for example, a user changes the position of the apparatus 10.

In some further embodiments, the detector 8 is configured to provide the control signal 9 in response to the detection of a change for a highest level frequency component within an analysed bandwidth.

In some other embodiments, the detector 8 is configured to provide the control signal 9 in response to the detection of a change for a range of frequency band from the full frequency response.

The detector 8 in such embodiments is linked to the filter 2 so that the control signal 9 is provided to the filter 2. The control signal 9 in these embodiments can control the filter 2 to filter the electrical input signal 3 so to compensate for the detected change as discussed above. For example the detected change can as discussed above be in the relative frequency response or the signal level. At least one of the shape, value, or bandwidth of the control signal 9 can depend on the change or triggering. For example the frequency response or the signal level of the control signal can depend on the detected change or trigger. In some embodiments, the detected change may be related to both the frequency response and the signal level.

In some embodiments the detector 8 can detect a change in the frequency response of the electrical output signal 17 in a first lower frequency band relative to the frequency response of the filtered electrical input signal 5 in the first lower frequency band. The change may be determined by, for example, dividing the frequency response of the electrical output signal 17 in a first lower frequency band by the frequency response of the filtered electrical input signal 5 in the first lower frequency band.

In some embodiments the detector can normalize the frequency response of the electrical output signal 17 in a first frequency band with respect to the frequency response of the electrical output signal 17 in a second frequency band. This may be achieved by dividing the frequency response of the electrical output signal 17 in the first frequency band by the frequency response of the electrical output signal 17 in the second frequency band. In some embodiments the first frequency band can be a lower frequency band to the second frequency band.

Similarly in some embodiments the frequency response of the filtered electrical input signal 11 in a first frequency band may be normalized with respect to the frequency response of the filtered electrical input signal 11 in a second frequency band. This may be achieved by dividing the frequency response of the filtered electrical input signal 11 in the first frequency band by the frequency response of the filtered electrical input signal 11 in the second frequency band. In some embodiments the first frequency band can be a lower frequency band to the second frequency band.

In some implementations, a change in frequency response may be simultaneously determined for multiple different frequency bands. The same frequency band in some embodiments can be used as a normalizing reference. In such embodiments the higher frequency band can be used as the reference frequency band.

In some embodiments the detector can divide signals into different frequency bands using band-pass filters. A band-pass filter is a filter that allows a selected frequency band to pass either because it is a band-pass filter. In other implementations, the detector can in some embodiments comprise a time domain to frequency domain transformer used to convert signals from the time domain to spectral bands in the frequency domain.

For example, if the detector 8 has detected an increase in the frequency response for the low frequency band then the control signal 9 can control the filter 2 to attenuate the low frequency components of the electrical input signal 3. Conversely if the detector 8 has detected a decrease in the frequency response of the low frequency band then the control signal 9 can control the filter 3 to enhance the low frequency components of the electrical input signal 3.

In some alternative embodiments, the detector 8 may be configured to provide the control signal 9 in response to the detection of a change in the time domain. For example, the change or difference in the time domain signals can be detected by a suitably designed algorithm such as a cross-correlation process between the electrical output signal 17 from the microphone 16 and the filtered electronic input signal 11. In some embodiments, the cross-correlation process may comprise a cross-correlation network. The cross-correlation network can be provided signals from at least one suitably arranged filterbank so that the at least one filterbank filters the electrical output signal 17 and the electronic input signal 11 wherein the outputs may be provided to the cross-correlation network. The change or difference after the cross-correlation process can then be used to control the filter 2. For example, the cross-correlation process may detect the change or difference comprising an environmental noise around the mobile phone 10 which can be used to configure the filter 2. In further embodiments, the cross-correlation process is used in addition to frequency domain analyses.

The speaker module 4 in some embodiments is positioned within the mobile phone 10 so that the acoustic signal 12 is directed outwards from the sound outlet 114. The microphone 16 is furthermore in these embodiments suitably positioned within the mobile phone 10. The microphone 16 in some embodiment can be an internal microphone of the mobile phone 10 wherein the microphone 16 may be used for a speech call. In some embodiments, the microphone 16 can be an additional or secondary microphone positioned in the mobile phone 10 and providing the acoustic input signal 18 into electrical output signal 17 to the detector 8. In some embodiments, there is more than one microphone that provides the acoustic input signal 18 to the detector 8 wherein the detector 8 is configured to provide the control signal 9 in response to the detection of a change using more than one acoustic input signal provided by more than one microphone.

In the example embodiment of the invention illustrated in FIG. 1 the microphone inlet 112 is provided for the microphone 16 is positioned suitably in the mobile phone 10. It is understood that this position is an example arrangement and can be used to other applications for the mobile phone 10 such as a speech call, audio recording etc. The microphone 16 is configured to be positioned so that it provides a measure of the frequency response of the sound generating system "or acoustic transfer function" comprising the mobile phone 10 and surrounding objects and also may include the user. The microphone 16 in these embodiments can be positioned to detect at least one acoustic input signal which is reflected from the objects around the mobile phone 10. For example, the mobile phone 10 may be positioned on a flat surface wherein the acoustic input signal 18 may comprise acoustic components from the acoustic signal 12 and related reflections from the flat surface or other surrounding objects.

FIG. 4 illustrates a flow chart showing a method which may be carried out by an apparatus 10 according to embodiments. Blocks, steps or operations 40, 42, 44 and 46 of the method in some embodiments can be carried out by the detector 8. Block, step or operation 48 can in the same embodiments be carried out by the filter 2.

At block 40 the detector 8 receives the filtered electronic input signal 11 as a first input. The filtered electrical input signal is also provided to the speaker module 4 where it is converted into the audible or acoustic signal 12. The electronic input signal 11 corresponds to the electrical input signal 3 which has been filtered by the filter 2.

As mentioned above the filtered electrical output signal 5 may comprise a plurality of frequency components or at least one frequency component. The plurality of frequency components can for example comprise a high frequency band, a mid frequency band and a low frequency band.

At block 42 the detector 8 receives the electrical output signal 17 provided by the microphone 16. The electrical output signal 17 corresponds to an acoustic input signal 18 which has been detected by the microphone 16. The detected input acoustic signal 18 may provide a measure of the frequency response of the system or acoustic transfer function comprising the mobile phone 10, surrounding objects and also possibly including the user. The detected acoustic input signal 18 in some embodiments comprises components of the acoustic signal 12. The electrical output signal 17 may also comprise a plurality of frequency components or at least one frequency component. The plurality of frequency components can also comprise a high frequency band, a mid frequency band and a low frequency band.

At block 44 the detector 8 detects a change in the frequency response of the electrical output signal 17 relative to the electronic input signal 11. The change in relative frequency response may arise, for example, if the user changes the way they are holding the apparatus or if the user places the apparatus on a flat surface. For example, the user in a noisy environment may position the mobile phone 10 more closely to the user's ear. This reduces the air gap between the mobile phone 10 and the user and so improves the perception of the acoustic signal 12. This motion of the mobile phone changes the frequency response of the speaker module 4 comprising the mobile phone 10, and surrounding objects.

The change in position of the mobile phone 10 can affect some frequencies more than others. For example the position of the mobile phone 10 may affect the high frequency band more than the low frequency band as illustrated in FIG. 5*b*.

FIG. 5*b* is an example of a plot of the frequency response of the speaker module 4 measured by the microphone 16 when the mobile phone 10 is positioned in a number of different ways. In this example embodiment of the invention, the sound outlet 114 is positioned on the front surface of the mobile phone 10 for illustration as presented in FIG. 5*a*.

The first plot 62 as shown in FIG. 5*b* corresponds to the mobile phone 10 being used in the free air position, for example when the user is holding the device in their hands away from their head. The second plot 60 as shown in FIG. 5*b* corresponds to the mobile phone 10 being positioned on a flat surface wherein the sound outlet 114 is facing up. The third plot 64 as shown in FIG. 5*b* corresponds to the mobile phone 10 being positioned on the same flat surface however the sound outlet 114 is facing down.

Although not shown on FIG. 5*a*, in some embodiments the mobile phone can comprise a recess area or at least one feature or specifically designed mechanical shape or sections as part of the mobile phone 10. This arrangement can in these embodiments act as a recess suitably positioned on a surface of the mobile phone 10 providing an air gap for the sound outlet 114 when the mobile phone 10 is positioned on a flat surface when the sound outlet 114 is facing down in order that the loudspeaker is not completely covered.

As can be seen from FIG. 5*b* the first plot 62 has the flatter frequency response for frequencies in the band 500 Hz to 3 kHz. When the mobile phone 10 is facing down, which is positioned on a flat surface, the second plot 60 has the highest frequency response in particular in the band 2 kHz to 5 kHz. When the mobile phone 10 is facing up, but is positioned on same flat surface, the third plot 64 has the lowest frequency response in particular in the band 2 kHz to 5 kHz. Therefore it can be seen that different positions changes the characteristics of the frequency response of the speaker module 4.

Referring back to FIG. 4, once the change in the frequency response has been detected the detector 8, at block 46, provides the control signal 9 to the filter 2. The characteristics of the control signal 9 may depend on whether the relative frequency response in the analysis bandwidth has increased or decreased. For example, it may depend on whether the user is using the phone in their hands or whether the user is positioned the mobile phone 10 on a flat surface. The characteristics of the control signal 9 may depend on the characteristics of the detected change in the frequency response. This may depend on the amount by which the user has operated the mobile phone 10 in different positions.

At block 48 the filter 2 receives the control signal 9 and filters the electrical input signal 3 provided to the speaker module 4. The control signal 9 controls the filter to compensate for the detected change in the frequency response.

Block 44 where the detector 8 detects a change in the frequency response of the electrical output signal 17 relative to the frequency response of the filtered electrical output signal 5 can be implemented either in parallel or serially for different frequency bands.

The blocks illustrated in FIG. 4 may represent steps in a method and/or sections of code in the computer program. The illustration of a particular order to the blocks does not necessarily imply that there is a required or preferred order for the blocks and the order and arrangement of the block may be varied. Furthermore, it may be possible for some steps to be omitted.

Embodiments of the application therefore provide the advantage that the filter 2 may be controlled to filter the electrical input signal 3 to compensate for any change of the audible or acoustic signal 12 which may arise as a result of a change in position of the mobile phone 10. This enables a good sound quality to be provided to a user irrespective of the position of the mobile phone 10.

Also embodiments can provide the advantage that they decrease the amplitude of the undesired frequency components which may prevent a reduced quality or even injury to a user and may also prevent damage to components of the mobile phone 10.

Embodiments of the application thus detect a change in the position of the mobile phone 10 by detecting a change in the frequency response. The frequency response calculation can be performed quickly. This means that only a small amount of processing power is required. Furthermore the speed of performing the comparison in some embodiments permits the mobile phone 10 to respond quickly to a change in the position of the mobile phone 10 so that the filter 2 may compensate for the change in position without any noticeable reduction in sound quality by the user.

In some embodiments of the application there may be a pre-determined filter list comprising a number of filters to suitably filter the electrical input signal 3 and provide the filtered electrical output signal 5 to the speaker module 4. The detector 8 can in these embodiments control the selection of one from the pre-determined filter list by the control signal 9.

In further embodiments, the mobile phone can comprise a suitably arranged sensor. For example the sensor can be at least one of an accelerometer, a proximity sensor, an ambient light sensor. The sensor in these embodiments can provide a detector control signal to the detector 8 wherein the detector control signal can affect the control signal 9 output to the filter 2. For example the sensor output can influence the detector 8 to select a suitable filter from the pre-defined filter list so that filter 2 may be the selected filter to filter the electrical input signal 3. For example, a sensor may detect motion of the mobile phone 10 or when the mobile phone is positioned upside down (i.e. when the mobile phone is positioned on a flat surface with the loudspeaker downwards) and accordingly assists the detector 8 to select one of the pre-determined filters which compensates for the face down dampening of the acoustic signal.

It is understood that in some embodiments the detector can configure the filter 2 by using either or both the microphone and the sensor.

FIG. 6 schematically illustrates a mobile phone 10 according to some further embodiments. The mobile phone 10 in these embodiments comprises a filter 2, a speaker module 4 and a microphone 16 as described in relation to the previous embodiments.

In FIG. 6 the detector 8 comprises a controller 201 which is configured to detect a change in the frequency response of the electrical output signal 17 provided by the microphone 16 relative to the filtered electrical input signal 3 provided to the speaker module.

The controller 201 provides means for controlling the filter 2. In some embodiments the controller 201 can also control other functions of the mobile phone 10. In the embodiments illustrated with respect to FIG. 6 the controller 201 comprises a processor 21 and a memory 22.

The controller 201 in such embodiments can be implemented using instructions that enable hardware functionality, for example, by using executable computer program instructions 109 in a general-purpose or special-purpose processor 21 that may be stored on a computer readable storage medium 211 (e.g. disk, memory etc) to be executed by such a processor 21.

The memory 22 in such embodiments can store a computer program 113 comprising computer program instructions 109 that control the operation of the filter 2 when loaded into the processor 21. The computer program instructions 109 provide the logic and routines that enables the mobile phone 10 to perform the methods illustrated in FIG. 4. The processor 21 by reading the memory 22 is able to load and execute the computer program 113.

The computer program instructions 109 can provide computer readable program means for enabling receiving a filtered electrical input signal 5 where the filtered electrical input signal 5 is also provided to a speaker module 4; receiving an electrical output signal 17 provided by a microphone 16; detecting a change in the frequency response of the electrical output signal 17 provided by the microphone 16 relative to the filtered electrical input signal 5 provided to the speaker module 4; and providing, in response to the detection of the change in the frequency response, a control signal 9 to a filter 2 to control the filter 2 to filter the electrical input signal 3 provided to the speaker module to compensate for the detected change in the frequency response.

The computer program 113 may arrive at the mobile phone 10 via any suitable delivery mechanism. The delivery mechanism may be, for example, a computer-readable storage medium 211, a computer program product, a memory device such as a flash memory, a record medium such as a CD-ROM or DVD, an article of manufacture that tangibly embodies the computer program 113. The delivery mechanism may be a signal configured to reliably transfer the computer program 113. The mobile phone 10 may propagate or transmit the computer program 119 as a computer data signal.

Although the memory 22 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific integration circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device.

The controller 201 is configured to receive the filtered electrical input signal 5 as a first input and the electrical output signal 17 provided by the microphone 16 as a second input. The controller 201 is configured to detect a change in the relative frequency response of the two signals as described above and provide the control signal 9 to the filter 2 to control the filter 2 to compensate for the detected change in the frequency response.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The embodiments described with reference to FIGS. 1 to 6 are particularly referred to speaker modules employed for sound reproduction for handsfree operations, however, according to alternative embodiments, additional sound outlet/s may be configured by means of employing air conduits such as connectors used for sound reproduction either alone or with at least one of other traditional outlets may provide sound reproduction for the mobile phone 10 near to the sound aperture 114. In some alternative embodiments, there may be other arrangements such as bass-reflex designs and/or multiple sound outlets. In some alternative embodiments, there may be multiple speaker modules and said arrangement may be used for a stereo design to provide a stereo widening or a 3D audio arrangement. It is understood that such example arrangements for at least one speaker module may be used for variety of handset use cases such as a music playback, speech call etc. In alternative embodiments, a single speaker module may be configured in such a way that the handset and handsfree operations may be benefited by configuring at least one sound outlet. In other alternative embodiments, there may be at least two speaker modules operate as a stereo playback.

Furthermore it should be realised that the foregoing embodiments should not be constructed as limiting. Other variations and modifications will be apparent to person skilled in the art upon reading the present application. The disclosure of the present application should be understood to include any novel features or any novel combination of features either explicitly or implicitly disclosed herein or any generalisation thereof and during the prosecution of the present application or of any application derived there from, new claims may be formulated to cover any such features and/or combination of such features.

Although it is not explicitly shown in FIGS. 1 to 6, the mobile phone 10 may comprise analogue and digital components configured to drive the loudspeaker 4. The mobile phone 10 thus in these embodiments may further comprise a digital signal processing (DSP) component. The mobile phone 10 in same or other embodiments may comprise a microprocessor or processor configured to control and carry out the operations of the mobile phone 10. In some embodiments the mobile phone may comprise a battery configured to power the electrical components of the mobile phone 10, such as for example the DSP component and processor. In some embodiments the analogue and digital components configured to drive the loudspeaker 4 may be in communication with the DSP component and with the microprocessor. In such embodiments the DSP and/or the microprocessor may control the analogue and digital components configured to drive the loudspeaker 4 to provide driving signals to the loudspeaker 4. In other embodiments the DSP component and/or the microprocessor may adjust signals fed to the loudspeaker 4, for example by providing an at least one of: an equalizer function, a gain control, a dynamic range controller, an excessive diaphragm movement prevention control. The operation of the DSP module and/or the microprocessor may in some embodiments improve performance of audio playback. Other alternative configurations are conceivable and are within the scope of this disclosure. According to example embodiments in a similar way to loudspeaker, the mobile phone 10 comprises analogue and digital components configured to process microphone signal captured by the microphone 16.

The embodiments described with reference to FIGS. 1 to 6 comprise the loudspeaker 4 and a substrate (not shown) configured to provide an electrical interface to at least one loudspeaker and at least one microphone. In some of the embodiments, the electrical interface may be achieved via a flexible connection which is interfaced with the substrate. In some of the above embodiments the substrate is furthermore configured to form a partially or substantially sealed rear cavity defined by one surface of the transducer. However, according to some other embodiments, the substrate may provide an electrical interface only for the loudspeaker 4 and there may be an additional substrate for the microphone 16. In these embodiments, the loudspeaker and/or the microphone may be supported by a suitably designed housing structure. It is understood that in such embodiments at least a substantial protection for the loudspeaker and/or for the microphone may be achieved against dust and other small particles.

Thus, a mobile phone 10 in some embodiments may comprise one or more of the transducers as described above wherein the transducer may be a loudspeaker, a microphone.

It shall be appreciated that the term mobile phone or user equipment is intended to cover any suitable type of equipment with an earpiece or speaker configuration, such as mp3 players, radio receivers and transceivers, and portable data processing devices or portable web browsers with audio capabilities. Furthermore, it will be understood that the term acoustic sound channels is intended to cover sound outlets, inlets, channels and cavities, and that such sound channels may be formed integrally with the transducer and/or with the connectors, or as part of the mechanical integration of the transducer and/or the connector with the device.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one speaker module disposed within the apparatus so as to generate sound emanating from the apparatus, wherein the at least one speaker module is at least one loudspeaker within the apparatus and acoustically coupled to an acoustic cavity and an aperture of the apparatus, to generate sound emanating from the apparatus towards a surrounding environment of the apparatus;

at least one microphone disposed within the apparatus such that there is a physical distance between the at least one loudspeaker and the at least one microphone, wherein the at least one microphone is disposed so as to detect sound in the vicinity of around the apparatus, wherein the at least one microphone is configured and positioned to provide an electrical output signal which can be represented in at least one of a frequency domain and a time domain and for detecting acoustic reflections of sounds from at least one object in the surrounding environment of the apparatus based on generated sounds from the at least one loudspeaker;

at least one filter configured to filter the electrical input signal and provide a filtered electrical input signal to the at least one loudspeaker of the apparatus for hands-free operations, and wherein the at least one loudspeaker is configured to convert the filtered electrical input signal to an acoustic signal; and a detector configured to receive as inputs the filtered electrical input signal and an electrical output signal provided by the at least one microphone; wherein the detector is configured to determine an acoustic effect caused by the reflections from the at least one object in the surrounding environment around the apparatus, and to determine at least one difference between the electrical output signal provided by the at least one microphone, based on the reflections from the at least one object, wherein sounds from the at least one object are reflected back to the microphone in the surrounding environment around the apparatus, and the filtered electrical input signal provided to the at least one loudspeaker, wherein the at least one difference comprises one or more of:

a difference between respective frequency responses based on the electrical output signal and the filtered electrical input signal;

a difference between the filtered electrical input signal and the electrical output signal in the time domain provided by a cross-correlation process; and wherein the detector is configured to provide, in response to the at least one difference, a control signal to the at least one filter to adjust the filtered electrical input signal, wherein the at least one filter adjusts the filtered electrical input signal depending on the control signal to generate an altered acoustic signal from the at least one loudspeaker to compensate for the determined acoustic effect caused by the reflections based on the at least one object in the surrounding environment around the apparatus.

2. The apparatus as claimed in claim 1, wherein the at least one difference further comprises at least one of:

a difference between a signal level of the filtered electrical input signal and a signal level of the electrical output signal provided by the at least one microphone; and a difference between a signal amplitude for at least one frequency region of the filtered electrical input signal and a signal amplitude for the same at least one frequency region of the electrical output signal provided by the at least one microphone.

3. The apparatus as claimed in claim 1, further comprising at least one sensor configured to determine a change in the position of the apparatus, wherein the at least one sensor is configured to provide a position indicator signal to the detector.

4. The apparatus as claimed in claim 1, wherein the at least one microphone is configured to detect the acoustic signal comprising at least one component generated by the at least one speaker module.

5. The apparatus as claimed in claim 1, wherein the at least one microphone is positioned in proximity to and outside of the at least one speaker module.

6. The apparatus as claimed in claim 1, wherein the filtered electrical input signal provided to the at least one speaker module and the electrical output signal provided by the at least one microphone comprise a first frequency band and a second frequency band, and the detector is further configured prior to determining at least one difference between the electrical output signal provided by the at least one microphone and the filtered electrical input signal provided to the at least one speaker module to:

determine an initial difference between the first frequency band of the filtered electrical input signal provided to the at least one speaker module and the first frequency band of the electrical output signal provided by the at least one microphone;

modify at least one of the filtered electrical input signal provided to the at least one speaker module and the electrical output signal provided by the at least one microphone, based at least in part on the initial difference.

7. The apparatus as claimed in claim 1, wherein the difference determined by the detector provides a measure comprising at least one of:

a frequency response of the surrounding environment of the apparatus; and a time domain response of the surrounding environment of the apparatus.

8. The apparatus as claimed in claim 1, wherein the apparatus is a wireless communications apparatus.

9. The apparatus of claim 1, wherein the detector is further configured to provide the control signal in response to detection of a change in at least one frequency component of the electrical output signal provided by the at least one microphone, and wherein the control signal is configured to compensate for the acoustic effect caused by a change in position of the apparatus.

10. The apparatus of claim 1, wherein the detector is configured to provide the control signal in response to the detection of a change for a highest level frequency component within an analysed bandwidth.

11. The apparatus of claim 1, wherein the detector is configured to provide the control signal in response to the detection of a change for a range of frequency band from the full frequency response.

12. The apparatus of claim 1, wherein the control signal is provided continuously in response to the electrical output signal provided by the at least one microphone.

13. The apparatus of claim 1, wherein the apparatus comprises a housing in which the at least one speaker module and the microphone are disposed, and wherein the apparatus includes a sound outlet for the at least one speaker module and a separate sound inlet for the microphone.

14. The apparatus of claim 1, further comprising:

a sensor configured to detect at least one of motion of the apparatus and whether the apparatus is facedown; and provide an input to the detector for selecting at least one of a plurality of predetermined filters to compensate for facedown dampening of the acoustic signal.

15. The apparatus of claim 14, further comprising:

a recess area positioned on a surface of the apparatus providing an air gap for the at least one speaker module when the apparatus is positioned face down on a flat surface.

16. The apparatus of claim 14, further configured to:

select the at least one of the plurality of filters based on at least one predetermined use case, wherein the at least one predetermined use case includes at least one of ringtone playback, music playback and a speech call.

17. The apparatus of claim 1, wherein the at least one microphone is configured to receive acoustic speech signals of a user of the apparatus.

18. The apparatus of claim 1, wherein the microphone is configured to detect an acoustic input signal, wherein the acoustic input signal comprises:

the altered acoustic signal from the at least one loudspeaker; and the acoustic reflections of sounds from the plurality of objects in the surrounding environment of the apparatus based on generated sounds from the at least one loudspeaker.

19. The apparatus of claim 1, wherein the control signal is provided when the frequency response of the electrical output signal from the microphone differs from the frequency response of the filtered electrical input signal by a predetermined threshold amount.

20. The apparatus of claim 19, wherein the predetermined threshold amount is determined by a frequency dependent value defined by a first set of known acoustic frequencies and a second set of known acoustic frequencies, wherein the first set of known acoustic frequencies are deemed more important than the second set of known acoustic frequencies.

21. The apparatus of claim 1, wherein the predetermined threshold amount is determined by a cumulative frequency error distribution defined by a weighted combination of a set of acoustic frequencies.

22. A method comprising:

receiving, from at least one filter, at least one filtered electrical input signal wherein the filtered electrical input signal is also provided to at least one speaker module of the apparatus for handsfree operations, wherein the at least one speaker module is at least one loudspeaker within an apparatus, wherein the at least one loudspeaker is configured to convert the filtered electrical input signal into an acoustic signal, and wherein the loudspeaker is acoustically coupled to an acoustic cavity and an aperture of the apparatus to generate sound emanating from the apparatus towards a surrounding environment of the apparatus;

receiving an electrical output signal provided by at least one microphone disposed within the apparatus such that there is a physical distance between the at least one loudspeaker and the at least one microphone, wherein the at least one microphone is disposed so as to detect sound around the apparatus, wherein the at least one microphone is configured and positioned to provide an electrical output signal which can be represented in at least one of a frequency domain and a time domain and for detecting acoustic reflections of sounds from at least one object in the surrounding environment of the apparatus based on generated sounds from the at least one loudspeaker;

filtering, by the at least one filter, the electrical input signal and providing a filtered electrical input signal to the at least one loudspeaker;

determining an acoustic effect caused by the reflections from the at least one object in the surrounding environment around the apparatus;

determining at least one difference between the electrical output signal provided by the at least one microphone, based on the reflections from the at least one object, wherein sounds from the at least one object are reflected back to the microphone in the surrounding environment around the apparatus, and the filtered electrical input signal provided to the at least one loudspeaker, wherein the at least one difference comprises one or more of:

a difference between respective frequency responses based on the electrical output signal and the filtered electrical input signal;

a difference between the filtered electrical input signal and the electrical output signal in the time domain provided by a cross-correlation process; and providing, in response to the at least one difference, a control signal to at least one filter to adjust the filtered electrical input signal, wherein the at least one filter adjusts the filtered electrical input signal depending on the control signal to generate an altered acoustic signal from the at least one loudspeaker to compensate for the determined acoustic effect caused by the reflections based on the at least one object in the surrounding environment around the apparatus.

23. The method as claimed in claim 22 wherein the least one difference comprises at least one of:

a difference between a signal level of the filtered electrical input signal and a signal level of the electrical output signal provided by the at least one microphone; and a difference between a signal amplitude for at least one frequency region of the filtered electrical input signal and a signal amplitude for the same at least one frequency region of the electrical output signal provided by the at least one microphone.

24. The method as claimed in claim 22, further comprising receiving a position indicator signal; and, in response to the position indicator signal, modifying the control signal.

25. The method as claimed in claim 22, further comprising locating the at least one microphone in proximity to the at least one speaker module.

26. The method as claimed in claim 22 wherein the filtered electrical input signal provided to the at least one speaker module and the output electrical signal provided by the at least one microphone comprise a first frequency band and a second frequency band, and the method, prior to determining at least one difference between the electrical output signal provided by the at least one microphone and the filtered electrical input signal provided to the at least one speaker module, comprises:

determining an initial difference between the first frequency band of the filtered electrical signal input signal provided to the at least one speaker module and the first frequency band of the electrical output signal provided by the at least one microphone; and modifying at least one of the filtered electrical input signal provided to the at least one speaker module and the electrical output signal provided by the at least one microphone, based at least in part on the initial difference.

27. The method of claim 22, further comprising:

detecting, by a sensor, at least one of motion of the apparatus and whether the apparatus is facedown; and providing an input to the detector for selecting at least one of a plurality of predetermined filters to compensate for facedown dampening of the acoustic signal.

28. A non-transitory computer readable medium storing a program of instructions, execution of which by at least one processor configures an apparatus to at least:

receive, from at least one filter, at least one filtered electrical input signal wherein the filtered electrical input signal is also provided to at least one speaker module of the apparatus for handsfree operations, wherein the at least one speaker module is at least one loudspeaker within the apparatus, wherein the at least one loudspeaker is configured to convert the filtered electrical input signal into an acoustic signal, and wherein the at least one loudspeaker is acoustically coupled to an acoustic cavity and an aperture of the apparatus to generate sound emanating from the apparatus towards a surrounding environment of the apparatus;

receive an electrical output signal provided by at least one microphone disposed within the apparatus such that there is a physical distance between the at least one loudspeaker and the at least one microphone, wherein the at least one microphone is disposed so as to detect sound around the apparatus, wherein the at least one microphone is configured and positioned to provide an electrical output signal which can be represented in at least one of a frequency domain and a time domain and for detecting acoustic reflections of sounds from at least one object in the surrounding environment of the apparatus based on generated sounds from the at least one loudspeaker;

filter, by the at least one filter, the electrical input signal and providing a filtered electrical input signal to the at least one loudspeaker;

determine an acoustic effect caused by the reflections from the at least one object in the surrounding environment around the apparatus;

process the electrical output signal and the at least one filtered electrical input signal to determine at least one difference in frequency response between the electrical output signal provided by the at least one microphone, based on the reflections from the at least one object, wherein sounds from the at least one object are reflected back to the microphone in the surrounding environment around the apparatus, and the filtered electrical input signal provided to the at least one loudspeaker, wherein the at least one difference comprises one or more of:

a difference between respective frequency responses based on the electrical output signal and the filtered electrical input signal;

a difference between the filtered electrical input signal and the electrical output signal in the time domain provided by a cross-correlation process; and provide, in response to the at least one difference, a control signal to at least one filter to adjust the filtered electrical input signal, wherein the at least one filter adjusts the filtered electrical input signal depending on the control signal to generate an altered acoustic signal from the at least one loudspeaker to compensate for the determined acoustic effect caused by the reflections based on the at least one object in the surrounding environment around the apparatus.

* * * * *